US005386856A

United States Patent [19]

Moody et al.

[11] Patent Number: 5,386,856

[45] Date of Patent: Feb. 7, 1995

[54] TENSION LIMITING STRAP TOOL

[75] Inventors: Roy A. Moody, Flossmoor; Larry A. Hillegonds, New Lenox, both of Ill.

[73] Assignee: Panduit Corp., Tinley Park, Ill.

[21] Appl. No.: 103,015

[22] Filed: Aug. 6, 1993

[51] Int. Cl.[6] ..... B21F 9/00

[52] U.S. Cl. ..... 140/123.5; 140/93.2

[58] Field of Search ..... 140/93 A, 93.2, 93.4, 140/123.5, 123.6

[56] References Cited

U.S. PATENT DOCUMENTS 3,169,560 2/1965 Caveney et al. ..... 140/123.6
3,993,109 11/1976 Fortsch .
4,202,384 5/1980 Aubert .
4,321,952 3/1982 Natkins .
4,733,701 3/1988 Loisel et al. .
4,947,901 8/1990 Rancour et al. .
5,048,575 9/1991 Smith .
5,065,798 11/1991 Alletto et al. .

*Primary Examiner*—Lowell A. Larson
*Attorney, Agent, or Firm*—Charles R. Wentzel; Mark D. Hilliard; Robert A. McCann

[57] ABSTRACT

A tension limiting strap tool for tightening a cable tie around a bundle of wires or the like. The strap tool includes a pair of pivotally connected handles, one of the handles having a cam surface that cooperates with a flexible barb member to hold an end of the cable tie strap as the handles are pivoted towards each other. One of the handles also includes at least one abutment surface that pushes away the cable tie head from the held strap end, and thus tightens the cable tie around the bundle.

22 Claims, 4 Drawing Sheets

TENSION LIMITING STRAP TOOL

TECHNICAL FIELD

The present invention relates to a strap tensioning and cutting tool, and more particularly to a simple cable tie tensioning tool that includes a spring for limiting the tensioning action of the tool.

BACKGROUND OF THE INVENTION

In applications using cable ties and the like, it is important to make sure that the cable ties are properly fastened around the bundle. Since it is usually difficult and inefficient for the user to simply use his hands for tightening the cable tie, strap tensioning tools are used. A major problem with most current cable tie strap tensioning tools is that they are complicated hand tools which require a great deal of time, effort, and skill to manufacture and are often difficult to operate. They often include numerous pivoting, bending and sliding members that are not only more difficult to manufacture but can also lead to a higher occurrence of breakdowns or defects of the tools during use. Additionally, while the cable tie must be sufficiently tightened to properly secure the bundle, overtightening can also cause difficulties such as strap failure or other damage. Therefore, it is important to have a simple device that can easily tighten the cable tie tightly around a bundle of wires without over-tightening the strap. It is also frequently desirable to be able to selectively cut off the excess strap from a tightened cable tie using the tightening tool.

SUMMARY OF THE INVENTION

It is therefore an object of the present invention to provide a cable tie strap tensioning tool having reduced complexity.

It is another object of the present invention to provide a simple cable tie tensioning and cutting tool having the ability to automatically stop tightening upon reaching a desired tension.

It is yet another object of the present invention to provide a simple cable tie strap tensioning tool that tightens the strap around a bundle by holding the strap end in a fixed position while pushing the cable tie head along the strap in a tightening direction.

These and other objects, together with the advantages thereof over existing prior art forms, which will become apparent from the following specification or accomplished by means hereinafter described.

In general, a strap tensioning tool for tightening a cable tie, having a strap and a locking head, includes a top and a bottom handle pivotally attached and biased apart, means for holding a strap end that has been passed through the locking head, actuated by the pivoting together of the top and bottom handles, and means for pushing the locking head along the strap in a direction away from the held strap end, for tightening the cable tie, actuated by the pivoting together of the top and bottom handles.

DESCRIPTION OF THE PREFERRED EMBODIMENT

Figure 1:
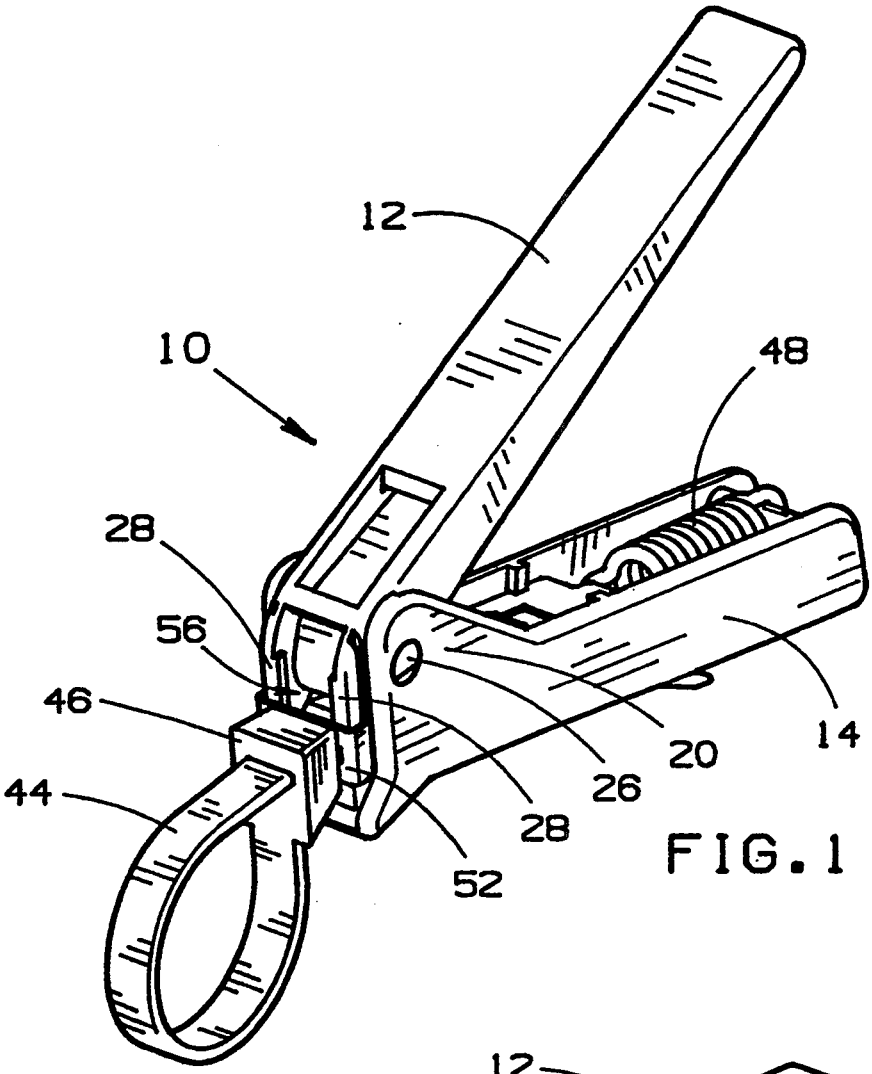
FIG. 1 is a perspective view of a strap tensioning tool engaged with a cable tie strap embodying the concept of the present invention.
Figure 2:
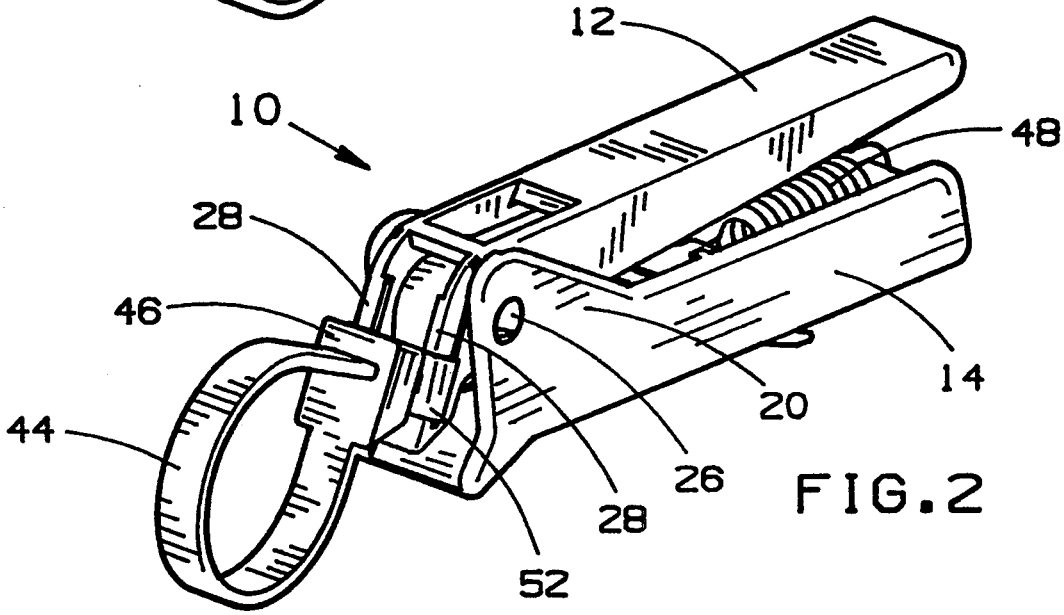
FIG. 2 is a perspective view of the strap tensioning tool of FIG. 1 in the actuated position.

A cable tie strap tensioning tool embodying the concept of the present invention is designated generally by the reference numeral 10 in the accompanying drawings.

Figure 3:
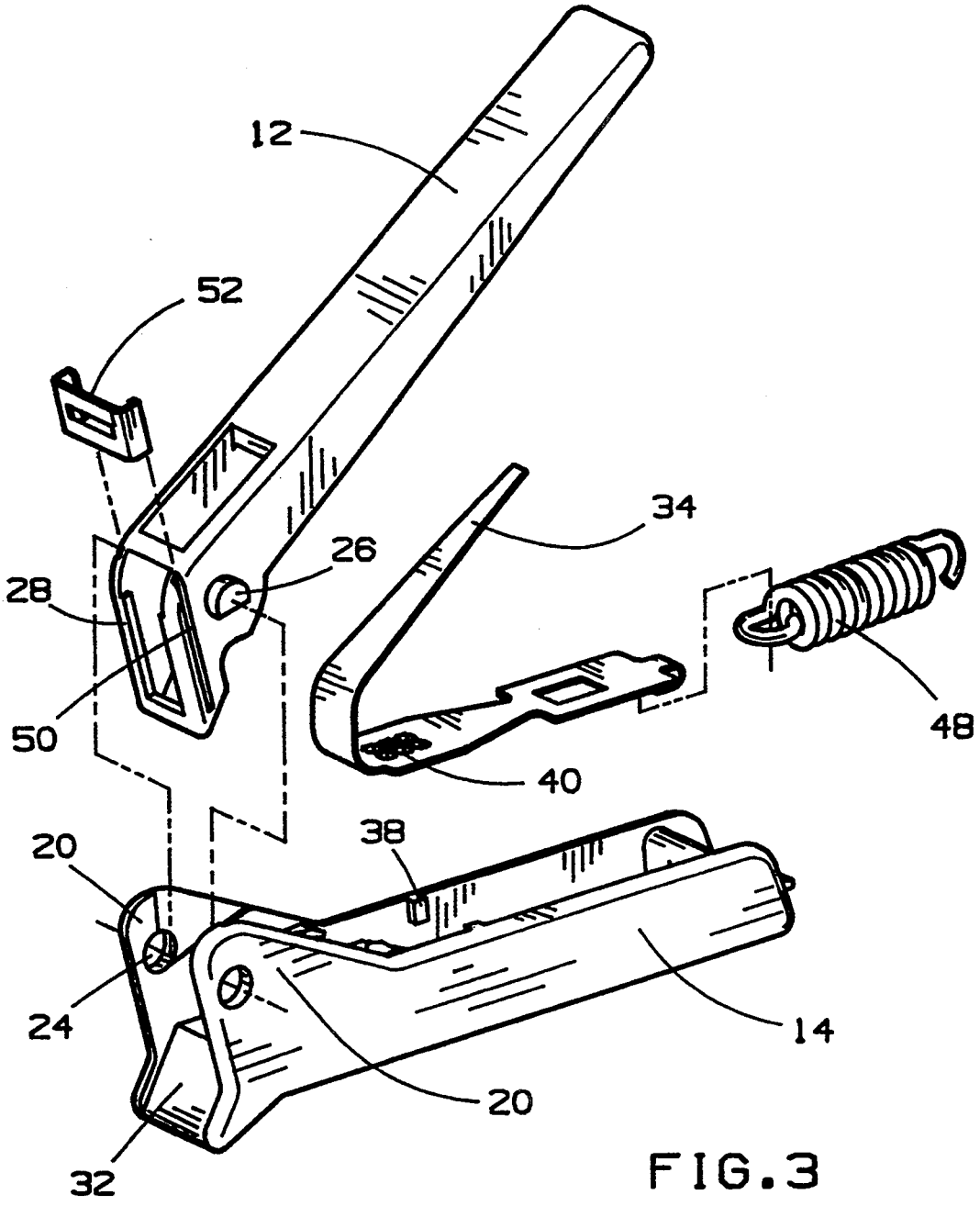
FIG. 3 is an exploded view of the strap tensioning tool of FIG. 1.
Figure 4:
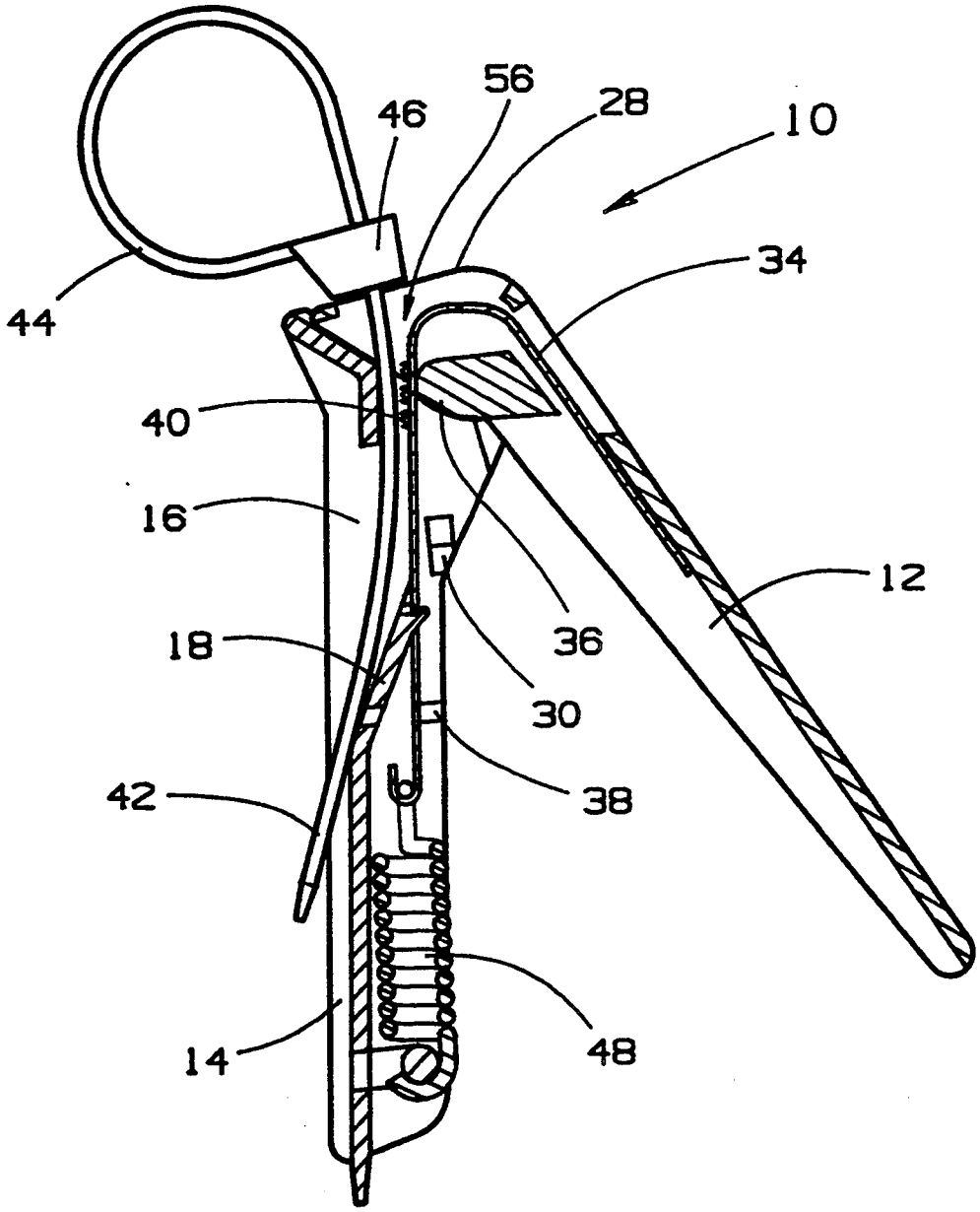
FIG. 4 is a sectional side view of the strap tensioning tool of FIG. 1.

As can be seen in FIG. 1, strap tensioning tool 10 includes a top handle 12 pivotally attached at a front end to a bottom handle 14. Bottom handle 14 is generally channel-shaped having a floor portion and a pair of vertical side walls. As can be seen in FIG. 4, the floor of bottom handle 14 is provided with an opening 16 that acts as a strap exit passageway. The floor of bottom handle 14 further includes a frontwardly inclined portion 18 adjacent opening 16 that creates a strap guiding surface for leading a strap end 42 into strap exit opening 16. As best seen in FIG. 3, bottom handle 14 is further provided with a pair of side wall extension surfaces 20 along its front end. Each side wall extension surface 20 is provided with a pivot engaging aperture 24. As can be seen in FIG. 4, top handle 12 is similarly formed having a general channel shape with a floor and a pair of vertical side walls. The top and bottom handles 12, 14 are connected so that the floor of the channel of top handle 12 faces the floor of the channel of bottom handle 14. Top handle 12 has pivot pins 26, disposed on each outer side of the side walls of the handle member near the front end, which engage apertures 24 of extended side wall surfaces 20 of bottom handle 14 to allow for the pivotable connection of the two handles. The front end of top handle 12 also includes a pair of spaced apart pusher surfaces 28 extending downward towards bottom handle 14 and joined at their ends by a transverse bar member. The spaced apart pusher surfaces 28 of top handle 12 and extended side wall surfaces 20 of the channel-shaped extended side wall surfaces 20 of the channel-shaped bottom handle 14 along with the respective floor portions of the top and bottom handle members form a passageway 56 when the top and bottom handles 12, 14 are in engagement. The passageway 56 formed between the top and bottom handles 12, 14 is disposed to accept and position the strap end 42 of a cable tie 44 that has been inserted through a cable tie head 46 to enclose and secure a bundle 54.

Figure 5:
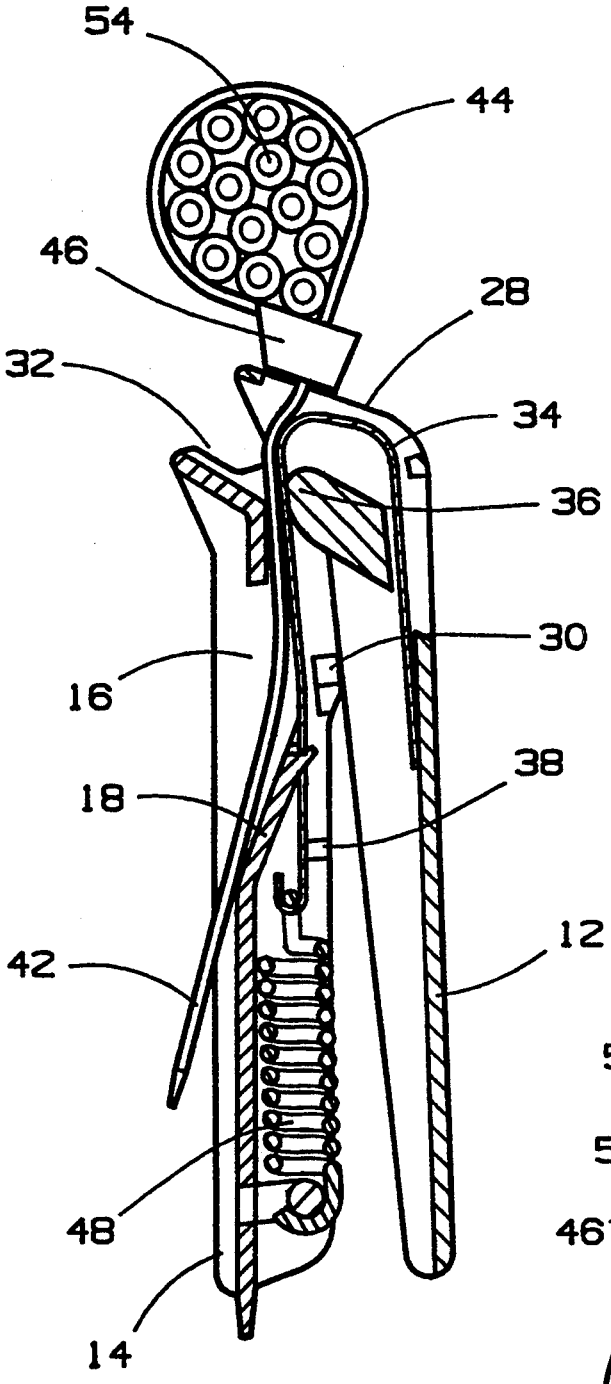
FIG. 5 is a sectional side view of the strap tensioning tool of FIG. 1 shown in the actuated position.

The top and bottom handles 12, 14 are pivotally mounted for rotation between a first biased apart position and a second compressed position. The pivoting range of top handle 12 is limited in the compressed position by a pair of stops 30 disposed on opposing inside surfaces of bottom handle 14 as best seen in FIG. 5. These stops 30 are located at a point that will stop the top handle 12 to prevent pinching of skin of the user. The pivoting range of top handle 12 in the biased apart position away from bottom handle 14 is also limited by the bottom ends and transverse bar of pusher surfaces 28 abutting an angled front floor portion 32 of bottom handle 14 as can best be seen in FIGS. 3 and 4.

As seen in FIG. 4, tensioning tool 10 also includes a handle return spring 34 that is situated between top handle 12 and bottom handle 14. Return spring 34 is formed from a single flat piece of tempered spring steel. Return spring 34 is bent into a general U-shape and is disposed so as to have a leg portion in each of the channel areas of both the top and bottom handles 12, 14, and so that the bent portion is situated around a cam surface 36 formed integrally with the front end of top handle 12. Return spring 34 is engaged with the channels of top and bottom handles 12, 14 in a manner so that they are biased apart. Return spring 34 is further secured by being positioned under a pair of spring guides 38 formed on the inside of the side walls of bottom handle 14. As best seen in FIG. 4, return spring 34 is provided with a plurality of gripper barbs 40 disposed on the underside of return spring 34 below cam surface 36.

In use, the leading end 42 of the cable tie strap that is intended to be tightened is inserted into passageway 56 of the front end. The user presses top handle 12 towards bottom handle 14 against the bias of return spring 34 causing top handle 12 to pivot towards bottom handle 14. As top handle 12 approaches bottom handle 14, cam surface 36 forces gripping barbs 40 into engagement with the leading end of strap 42 by pressing against the floor of bottom handle 14 thereby fixing strap end 42 in position. Pusher surfaces 28 which are in abutment with cable tie head 46 rotate away from the fixed leading strap end 42 held by gripping barbs 40 as top handle 12 pivots toward bottom handle 14. Therefore, cable tie head 46 is forced along the strap away from the fixed strap end 42 so as to tighten the cable tie 44 around bundle 54. When top handle 12 is released, handle return spring 34 forces the top and bottom handles 12, 14 apart which releases strap end 42 from the grip of barbs 40 and allows for further tightening. The excess part of strap end 42 is led through strap exit opening 16 by inclined portion 18 of the floor of bottom handle 14.

In order to prevent overtightening a tension limiting spring 48 is disposed within the channel of bottom handle 14 and is attached at one end to the back end of bottom handle 14 and at its other end to an end of return spring 34. During tensioning, as described above, when the spring force of tension limiting spring 48 is greater than the force required of pusher surfaces 28 to tighten cable tie 44, tension limiting spring 48 maintains the position of handle return spring 34 and gripper barbs 40 on return spring 34 to hold the leading end of strap 42 in place. However, after cable tie 44 has been tightened to a point where the force required of pusher surfaces 28 against cable tie head 46 to move cable tie head 46 along the strap in a tightening direction becomes greater than the restraining force exerted by tension limiting spring 48 on handle return spring 34, tension limiting spring 48 expands causing the return spring 34 and leading end of strap 42 to move forward along with cable tie head 46 and prevent further tightening as seen in FIG. 5.

Figure 6:
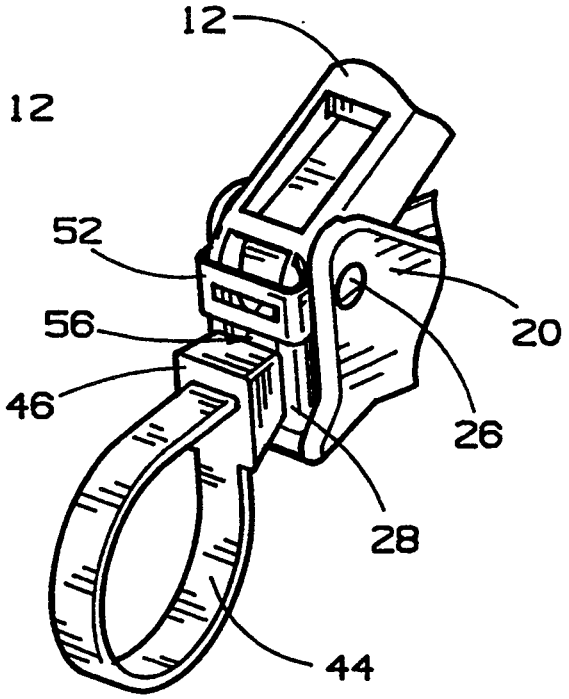
FIG. 6 is a fractional view of the front end of the strap tensioning tool of FIG. 1 shown with a cutter blade moved out of the strap path.

As can be seen in FIG. 3, the sides of pusher surfaces 28 are further provided with grooves 50 formed on each side which allows for engagement with a slidable metal cutter blade 52. Cutter blade 52 provides a strap slot having sharp edges around the slot in which the leading end of cable tie strap 42 is passed through. Cutter blade 52 engages grooves 50 at the front end of top handle 12, and is situated across the front of passageway 56. The slot of cutter blade 52 is dimensioned to have a height that is smaller than the width of strap 44, so that when the excess strap is ready to be cut off, tool 10 can simply be rotated by the user causing the sharp edges of cutter blade 52 to cut through the strap. As shown in FIG. 6, cutter blade 52 is selectively usable since it can be slid upwards in grooves 50 out of the way of the strap as it enters passageway 56.

While the particular embodiment of the present invention has been shown and described, it will be obvious to those skilled in the art that changes and modifications may be made without departing from the invention in its broader aspects. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A strap tensioning tool for tightening a cable tie having a strap and a locking head, comprising:

a top and a bottom handle pivotally attached and biased apart; a cam surface integrally formed on the top handle; a handle return member having strap gripping barb means positioned adjacent the cam surface so that the strap gripping barb means is forced onto a strap end when the top and bottom handles are pivoted together; and means for tightening the cable tie, actuated by the pivoting together of the top and bottom handles.

2. A strap tensioning tool according to claim 1, wherein the strap gripping barb means comprises at least one barb formed on the handle return member.

3. A strap tensioning tool according to claim 2, wherein the means for pushing the cable tie head comprises at least one pusher surface located at a front end of the top handle so that upon rotation of the handles towards each other the pusher surface pushes the cable tie head in a direction that tightens the cable tie while the strap end is securely held in position.

4. A strap tensioning tool according to claim 3, further including means for automatically limiting the tightening of the cable tie around the bundle to prevent overtightening.

5. A strap tensioning tool in accordance with claim 4, wherein the tension limiting means includes a tension limiting spring attached to the means for holding the strap end.

6. A strap tensioning tool according to claim 4, further comprising, cutting means for cutting off the excess strap end at a point near the cable tie head after tightening.

7. A strap tensioning tool according to claim 5, wherein the cutting means includes a cutter blade having a strap receiving slot.

8. A strap tensioning tool for tightening a cable tie, having a strap and a locking head, comprising:

a top and a bottom handle pivotably connected and rotatable between a biased apart first position and a compressed together second position, a flexible return member, situated between the top and bottom handles so as to bias the top and bottom handles apart into the first position, the return member including barb means for engaging with a strap end to prevent the strap end from moving as the handles are pivoted together into the second position; and means for tightening the cable tie as the handles are pivoted together into the second position.

9. A strap tensioning tool according to claim 8, wherein the pushing means comprises at least one abutment surface formed at a front end of the top handle which abuts the cable tie head and rotates away from the fixed strap end as the top handle is pivoted towards the bottom handle into the second position.

10. A strap tensioning tool according to claim 9, wherein the top handle further includes a cam surface facing the bottom handle which presses the barb means onto the strap end as top handle is pivoted towards the bottom handle into the second position.

11. A strap tensioning tool according to claim 10, further including means for limiting the tensioning of the cable tie around the bundle.

12. A strap tensioning tool according to claim 11, wherein the tension limiting means comprises a spring attached at one end to the return member and at the other end to the bottom handle.

13. A strap tensioning tool for tightening a cable tie having a strap and a locking head around a bundle comprising:

a bottom handle;

a top handle pivotally attached at a front end to a front end of the bottom handle;

a passageway, formed between the top and bottom handles, disposed to accept and position a strap end of the cable tie that has been inserted through a cable tie head;

a cam surface integral with the top handle and disposed so as to be facing the bottom handle;

a flexible return member situated between the top and bottom handles so as to bias them apart;

barb means for engagement with the strap to prevent it from movement as the top handle and the bottom handle rotate towards each other, disposed on the flexible return member adjacent the cam surface; and pushing means integral with the top handle that pushes a locking head of the cable tie away from the held strap as the top handle rotates toward the bottom handle.

14. A strap tensioning tool according to claim 13, wherein the pushing means includes at least one pusher surface located at the front end of the top handle.

15. A strap tensioning tool according to claim 14, wherein the barb means includes at least one barb formed on the flexible return member.

16. A strap tensioning tool according to claim 15, wherein the preventing from movement of the strap by the barb means and the pushing away of the head by the pushing means are both actuated by the pivoting motion of the top handle and the bottom handle towards each other.

17. A strap tensioning tool according to claim 16, further comprising means for limiting the tensioning force that can be applied to the cable tie.

18. A strap tensioning tool according to claim 17, wherein the means for limiting the tension force comprises a tension limiting spring attached at one end to a back end of the bottom handle and at an opposite end to an end of the flexible return member, whereby when the cable tie is tensioned to a force equal to that of the spring force of the tension limiting spring, the tension limiting spring extends resulting in the flexible return member and the strap held by the barb means to move forward along with the tension limiting spring so that further tightening of the cable tie is avoided as the pushing means pushes on the cable tie head.

19. A strap tensioning tool according to claim 18, wherein the bottom handle is generally channel-shaped.

20. A strap tensioning tool according to claim 19, wherein the bottom handle further includes a strap exit passageway.

21. A strap tensioning tool according to claim 20, further comprising a cutter blade selectively attachable to the top handle at a point near the pusher surfaces, wherein the cutter blade has a slot for the strap end to be passed through as the strap end is inserted into the passageway formed between the top and bottom handles.

22. A strap tensioning tool according to claim 21, wherein the cutter blade is movable so that it is selectively engageable with the strap end as the strap end is inserted into the passageway between the top and bottom handles.

* * * * *

UNITED STATES PATENT AND TRADEMARK OFFICE

CERTIFICATE OF CORRECTION

PATENT NO. : 5,386,856

DATED : February 7, 1995

INVENTOR(S) : Moody, et al.

It is certified that error appears in the above-identified patent and that said Letters Patent is hereby corrected as shown below:

Column 4, line 48, change "claim 4" to --claim 5--.

Column 4, line 52, change "claim 5" to --claim 6--.

Signed and Sealed this

Sixth Day of June, 1995

Bruce Lehman

*Attest:*

BRUCE LEHMAN

*Attesting Officer*

*Commissioner of Patents and Trademarks*